US007132954B2

(12) United States Patent
Shebek et al.

(10) Patent No.: US 7,132,954 B2
(45) Date of Patent: Nov. 7, 2006

(54) SELF MONITORING POOL COVER SYSTEM

(75) Inventors: Michael Shebek, Carmel, IN (US); Michael Caron, Indianapolis, IN (US)

(73) Assignee: Automatic Pool Covers, Inc., Fishers, IN (US)

( * ) Notice: Subject to any disclaimer, the term of this patent is extended or adjusted under 35 U.S.C. 154(b) by 179 days.

(21) Appl. No.: 10/884,897

(22) Filed: Jul. 6, 2004

(65) Prior Publication Data

US 2005/0012629 A1 Jan. 20, 2005

Related U.S. Application Data

(60) Provisional application No. 60/485,285, filed on Jul. 7, 2003.

(51) Int. Cl.
*G08B 21/00* (2006.01)

(52) U.S. Cl. ..... 340/679; 340/545.1; 340/545.6; 340/672; 340/573.1; 340/573.6; 4/502; 4/504

(58) Field of Classification Search ..... 340/679, 340/545.2, 545.6, 672, 676, 686.1, 686.6, 340/573.1, 573.6, 545.1; 4/502, 504; 160/133, 160/311

See application file for complete search history.

(56) References Cited

U.S. PATENT DOCUMENTS 4,203,174 A * 5/1980 Schults ..... 4/502
4,459,711 A 7/1984 Sartain et al.
4,464,801 A 8/1984 Lamb
4,466,143 A 8/1984 Lamb
4,466,144 A 8/1984 Lamb
4,494,256 A 1/1985 Radtke et al.
4,686,717 A 8/1987 MacDonald et al.
4,811,433 A 3/1989 MacDonald et al.
4,815,152 A 3/1989 MacDonald et al.
4,858,253 A 8/1989 Lamb
4,939,798 A 7/1990 Last
4,955,092 A 9/1990 Hagan
5,044,022 A 9/1991 Hess
5,067,184 A 11/1991 Last
5,105,481 A 4/1992 Lamb et al.
5,184,356 A 2/1993 Lof et al.
5,184,357 A 2/1993 Last
5,349,707 A 9/1994 Last
5,524,302 A 6/1996 Ragsdale et al.
5,533,214 A 7/1996 Graham (Continued)

FOREIGN PATENT DOCUMENTS

DE 3739465 C1 2/1989

(Continued)

*Primary Examiner*—Hung Nguyen
(74) *Attorney, Agent, or Firm*—Baker & Daniels LLP

(57) ABSTRACT

System and method for monitoring a working status of a swimming pool cover assembly. The system comprises a pool cover assembly operably connected to an alarm apparatus; both may be operably connected to a plurality of sensors capable of detecting a working status of the pool cover assembly and sending a signal to the alarm apparatus. The alarm apparatus continually produces at least one humanly perceptible indication corresponding to a working status of the pool cover assembly. The alarm apparatus includes at least one alarm-producing device, such as an audio or visual device, or combination of the two, a receiver operably connected to the plurality of sensors for receiving the signals, a processor operably coupled with the receiver for processing and recognizing the received signals, and software operably coupled with the processor enabling the alarm-producing device to produce the humanly perceptible indication corresponding to the recognized signal.

37 Claims, 8 Drawing Sheets

U.S. PATENT DOCUMENTS 5,546,751 A 8/1996 Last
5,799,342 A 9/1998 Last
5,890,240 A 4/1999 Graham
5,913,613 A 6/1999 Ragsdale et al.
5,920,922 A 7/1999 Ragsdale et al.
5,930,858 A 8/1999 Jung
6,014,778 A 1/2000 Varnado
6,026,522 A * 2/2000 Last ..... 4/502
6,324,706 B1 12/2001 Epple
2001/0023506 A1 9/2001 Mathis et al.
2001/0029626 A1 10/2001 Mathis
2001/0034905 A1 11/2001 Mathis
2001/0034906 A1 11/2001 Last
2002/0046817 A1 4/2002 Last
2002/0050004 A1 5/2002 Epple

FOREIGN PATENT DOCUMENTS

FR 2 577 264 A1 2/1985

* cited by examiner

SELF MONITORING POOL COVER SYSTEM

BACKGROUND OF THE INVENTION

1. Field of the Invention

The field of the present invention relates to swimming pools and more particularly alarm systems for swimming pool covers.

2. Description of the Related Art

Swimming pool covers are used to prevent debris from entering the pool, and to maintain water temperature of a heated pool. An automatic pool cover system allows the pool cover to be easily extended over the pool when the pool is closed, or retracted when the pool is open. A typical automatic pool cover system usually includes a pool cover made of a synthetic material such as a durable plastic, a drive mechanism such as a reel positioned at one end of the pool for winding the pool cover, a drive control for driving the drive mechanism, and a power source for supplying power to the drive control. Further included in the automatic pool cover system may be a pair of tracks extending along each sidewall of the pool and coping, which is a formed material disposed along the periphery of the pool and above the water level. The tracks may be top-mounted to the surface deck or under-mounted to the coping.

A drawback of a typical automatic pool cover system is that when the system is activated for closing or opening, the cover continues to move until the operation is terminated either by an automatic shut off or by a pool operator turning off a control switch. Problems may arise under a circumstance in which the operator of the pool cover is unaware of the presence of pool users in the pool when he operates to close the pool. The pool users may be trapped under the pool cover. In addition, the pool cover system may fail or break if the cover is retracted while carrying an extra weight due to accumulated water or debris on the cover.

One known automatic pool cover with a warning and safety system alerts pool users when the cover is activated. This particular safety system has at least one sensor for detecting the presence of a heat generating body in the pool. The sensor then generates and sends a signal in response to the presence of the heat generating body to a controller. The controller receives the signal and activates a safety protocol in response to the signal. The safety protocol includes terminating the pool cover closing, preventing users or animals to be trapped under the cover.

A disadvantage of this system is that an alarm will be set off only when the system is working. However, in a circumstance in which the sensor is malfunctioned, the alarm may not work. In addition, if the power failure occurs, the safety system may not operate. The pool cover operator or the pool users cannot be readily aware of any failure of either the components of the pool cover system, or the alarm system. The consequence may be irreparable damages.

SUMMARY OF THE INVENTION

The present invention provides a self monitoring pool cover system for a swimming pool. The system includes an alarm apparatus operably connected to a pool cover assembly. The alarm apparatus produces a humanly perceptible indication corresponding to the working status of the pool cover assembly. The system may include at least one of a plurality of sensors operably connected to the alarm apparatus and the pool cover assembly. Each of the plurality of sensors is capable of detecting a working status of the pool cover assembly, or components of the pool cover assembly.

Each sensor may produce a signal representing the detected working status, and send the signal to the alarm apparatus to activate the alarm apparatus to produce a humanly perceptible indication corresponding to the signal.

The alarm apparatus includes at least one alarm-producing device, which may be an audio device, a visual device, or a combination of the audio device and the visual device. The alarm apparatus may include a receiver for receiving the signals from the sensors, a processor operably coupled with the receiver for processing and recognizing the received signals, and software operably coupled with the processor enabling the alarm-producing device to produce humanly perceptible indications.

The system of the present invention may include a control switch operably connected to the pool cover assembly for turning on and turning off the pool cover assembly. The control switch may also be operably connect to the alarm apparatus for activating or deactivating the alarm apparatus. The control switch may include a key switch operably connected to the alarm-producing device, within a key switch box. The key switch box may define a key slot for receiving a control key.

The system may include a sensor adapted to produce and send an electronic signal, a radio frequency signal, or any other suitable type of signals. At the same time the receiver, and the processor of the alarm apparatus may be adapted to receive, process and recognize the corresponding type of signal.

The present invention further provides a method for monitoring working statuses of a pool cover assembly, comprising the steps of: (a) detecting a working status of a pool cover assembly, and (b) producing a humanly perceptible indication corresponding to the detected status of the pool cover assembly. The method may further include the steps of: (c) producing a signal representing the status of the pool cover assembly, (d) receiving the signal, and (e) processing and recognizing the signal.

The system may use a single sensor, providing several advantages: Allows for all electrical work to be performed on one side of the pool cover system; Eliminates the cost of an additional stop sensor; Eliminates up to 40 feet of 2-wire across the back of the cover housing; Eliminates connections from sensor to wire; Eliminates installation labor time of the second sensor; Allows for easier maintenance after the installation; and Eliminates one wire from the control box providing easier installation.

Another advantage of the present invention is a feature that can indicate a present working status of a pool cover assembly and a pool cover safety system.

A further advantage is a feature that can alert a pool operator of a system failure, and thus reduce the possibility of system damages.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Figure 1:
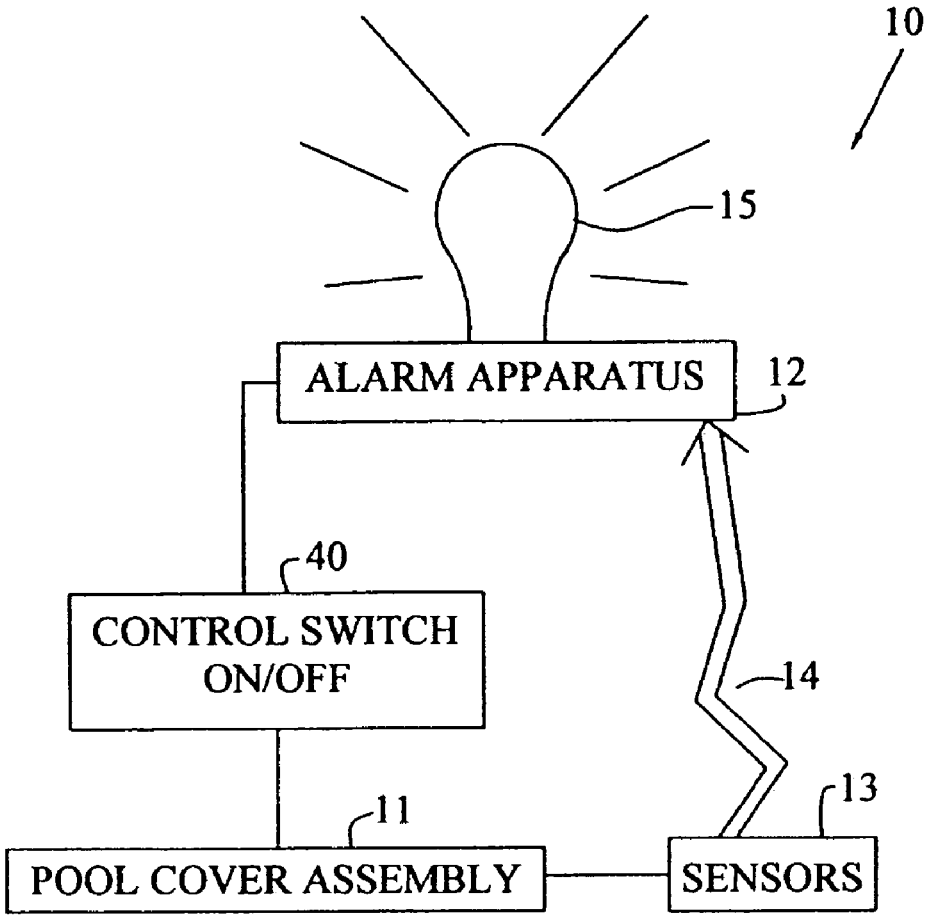
FIG. 1 is a schematic diagram showing the system according to one embodiment of the present invention.

Corresponding reference characters indicate corresponding parts throughout the several views. Although the drawings represent embodiments of the invention, the drawings are not necessarily to scale and certain features may be exaggerated or omitted in order to better illustrate and explain the present invention. The exemplifications set out herein illustrate embodiments of the invention, in several forms, and such exemplifications are not intended to be construed as limiting the scope of the invention in any manner.

DESCRIPTION OF THE INVENTION

The embodiments disclosed below are not intended to be exhaustive or limit the invention to the precise forms disclosed in the following detailed description. Rather, the embodiments are chosen and described so that others skilled in the art may utilize its teachings.

The present invention provides a self monitoring system for a pool cover. The system includes an alarm apparatus operably connected to a pool cover assembly. The alarm apparatus produces a signal that indicates a working status of the pool cover assembly and the alarm apparatus. With the present invention, the term "working status" refers to a condition of the pool cover system itself, not the condition of the pool or other item although such other status information may be added to the invention. The system may include a single sensor for monitoring one of the working states of the pool cover assembly. The system may also include multiple sensors for monitoring multiple aspects of the working states of the pool cover assembly.

As illustrated in the diagram of FIG. 1, self-monitoring pool cover system 10 for use with a swimming pool generally includes pool cover assembly 11 operably connected to alarm apparatus 12. System 10 further includes at least one, and in this embodiment, a plurality of sensors 13 operably connected to alarm apparatus 12 and pool cover assembly 11. Each of plurality of sensors 13 is adapted to detect a working status of pool cover assembly 11, produce signal 14 corresponding to the working status, and send signal 14 to alarm apparatus 12. Alarm apparatus 12 receives signal 14, processes and recognizes signal 14, and produces a humanly perceptible indication 15 corresponding to working status information indicated by signal 14.

System 10 may also include control switch 40 connected to pool cover assembly 11 for controlling the operation of pool cover assembly 11. Control switch 40 may be set to "on" position or "off" position, and it is also possible in alternative embodiments (not shown) to include other positions representing alternative modes of operation. When a pool operator desires to activate the operation of pool cover assembly 11, or open or close the pool cover, control switch 40 may be set to "on" position, when the pool operator desires to terminate the operation of pool cover assembly 11, control switch 40 may be set to "off" position.

In addition, control switch 40 may be operably connected to alarm apparatus 12. When control switch 40 is turned to "on" position, alarm apparatus 12 may be activated at the same time as the extension or retraction of pool cover. When control switch 40 is turned to "off" position, alarm apparatus 12 may be deactivated and pool cover is at a fully closed or fully open position. Alternatively, alarm apparatus 12 may have a separate control switch (not shown) that controls the operation of alarm apparatus 12, but not pool cover assembly 11. Alarm apparatus 12 may be set to constantly be in an operating mode.

Figure 2:
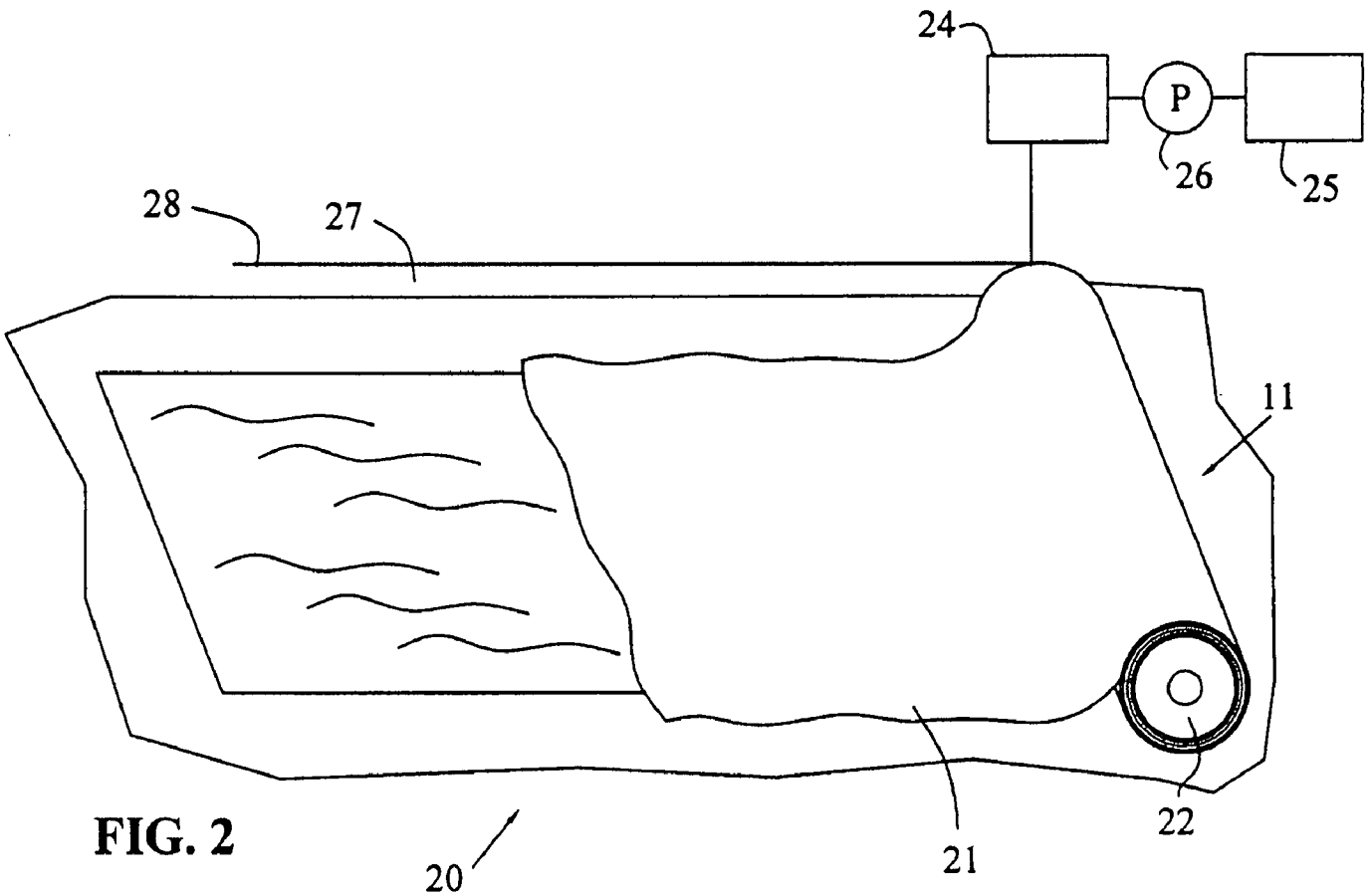
FIG. 2 is a cross-sectional schematic diagram showing a pool cover assembly.

As depicted in FIG. 2, pool cover assembly 11 includes pool cover 21, drive mechanism 22 connected to pool cover 21, drive control 23 operably connected to drive mechanism 22, and power source 25. Power source 25 may be an electrical socket connected to an external electricity source or an electricity generator or a transformer. Power source 25 is connected to drive control 23 for supplying power 26 to operate drive control 23. Drive control 23 may be an electrical motor that drives drive mechanism 22 to extend or retract pool cover 21. Drive mechanism 22 may be a reel or a roller that winds cover 21 around drive mechanism 22, when the pool is being open. Drive mechanism 22 unwinds cover 21 to extend cover 21 over the pool when the pool is being closed. Other components of pool cover assembly 11 may include a pair of tracks 27 and coping 28, the function of which are well known in the art.

Figure 3:
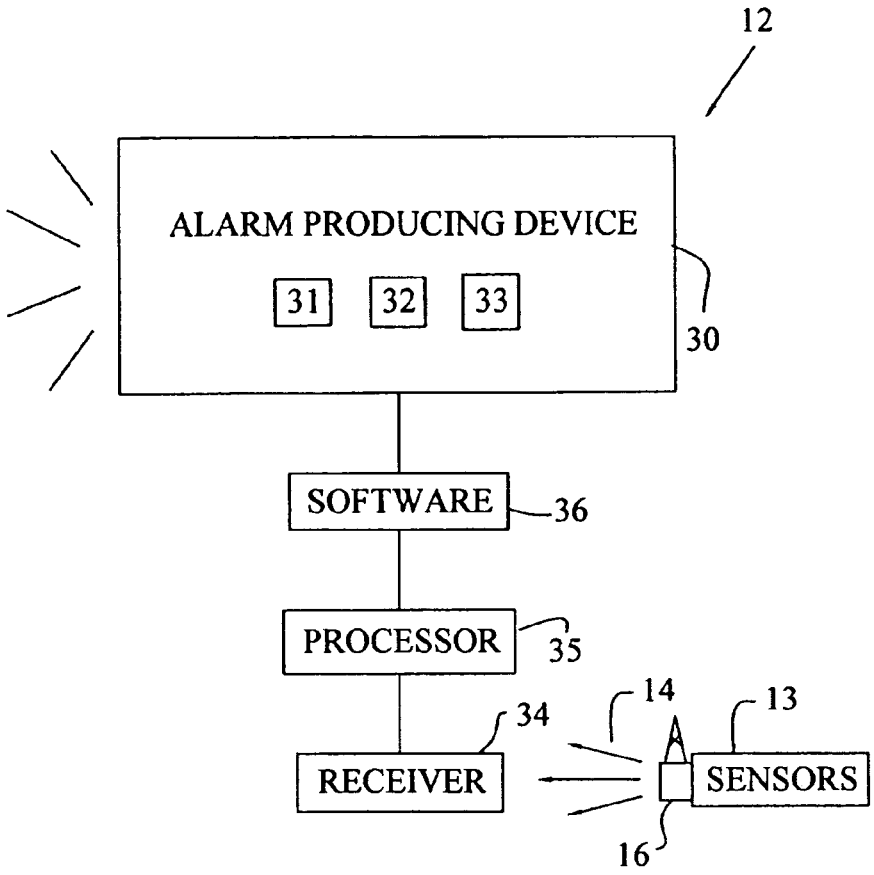
FIG. 3 is a schematic diagram showing components of a second embodiment of an alarm apparatus of the present invention.

According to FIG. 3, alarm apparatus 12 includes at least one output or alarm-producing device 30, which may be audio device 31, visual device 32, or combination 33 of audio device 31 and visual device 32. Audio device 31 may produce sounds of varying characteristics, such as a siren, a synthesized voice or a recorded voice. Visual device 32 may produce light of varying colors or readable signs or characters. The light, the sign or the characters may be stationary or blinking. There can be any numbers of audio device 31, and visual device 32 included in alarm-producing device 30.

As shown in FIG. 3, further included in alarm apparatus 12 may be receiver 34 for receiving sensor signals from one or more of the plurality of sensors 13, processor 35 operably coupled with receiver 34 for processing and recognizing signal 14, and software 36 operably coupled with processor 35 enabling alarm-producing device 30 to produce humanly perceptible indications corresponding to signal 14. Software 36 may be adapted to activate audio device 31, or visual device 32, or combination 33.

Figure 4:
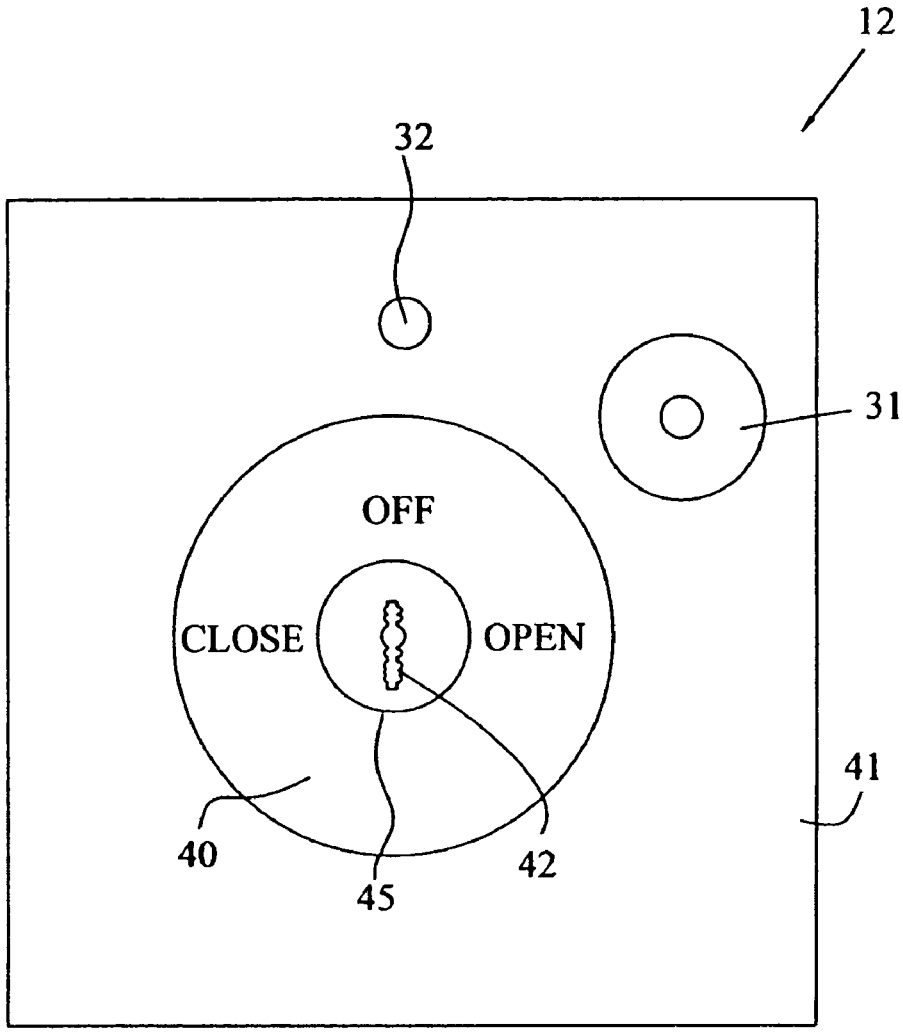
FIG. 4 is a front plan view of an alarm apparatus according to one embodiment of the present invention.

In one embodiment of alarm apparatus 12, shown in FIG. 4, Control switch 40 for controlling opening and closing of the pool cover may be connected to and integrated with alarm apparatus 12. Control switch 40 includes key switch 45 electrically connected with audio device 31 and visual device 32 of alarm apparatus 12, within key switch box 41. Key slot 42 is provided on key box 41 for receiving a control key (not shown). Visual device 32 may produce lights of different colors, such as green, red, blinking red or yellow. Each light color may indicate a specific status of pool cover assembly 11 shown in FIG. 1. Audio device 31 may be adapted to produce a siren to alert a pool cover operator of a specific malfunctioning status of pool cover assembly 11. Both siren and a red light may be produced as a combination of an alarm signal. Other combinations of audio and visual alarm signals may be predetermined to indicate specific statuses of pool cover assembly 11. The control key inserted in slot 41 may be turned to "open" position for opening the pool cover or "close" position for closing the pool cover.

One example of the operation of system 10 may be described as follows. If visual device 32 displays a green light, representing a normal operating status of pool assembly 11, the operator knows that it is safe to operate pool cover assembly 11. The pool operator may turn the control key to "open" position, the pool cover will retract and the pool is open. Alternatively, the pool operator may turn the control key to "close" position, the pool cover will extend over the pool and the pool will be closed. However, if visual device 32 displays a red light, representing a malfunction in the system, the pool cover will be alerted that operating pool cover assembly 11 may be unsafe.

Figure 5:
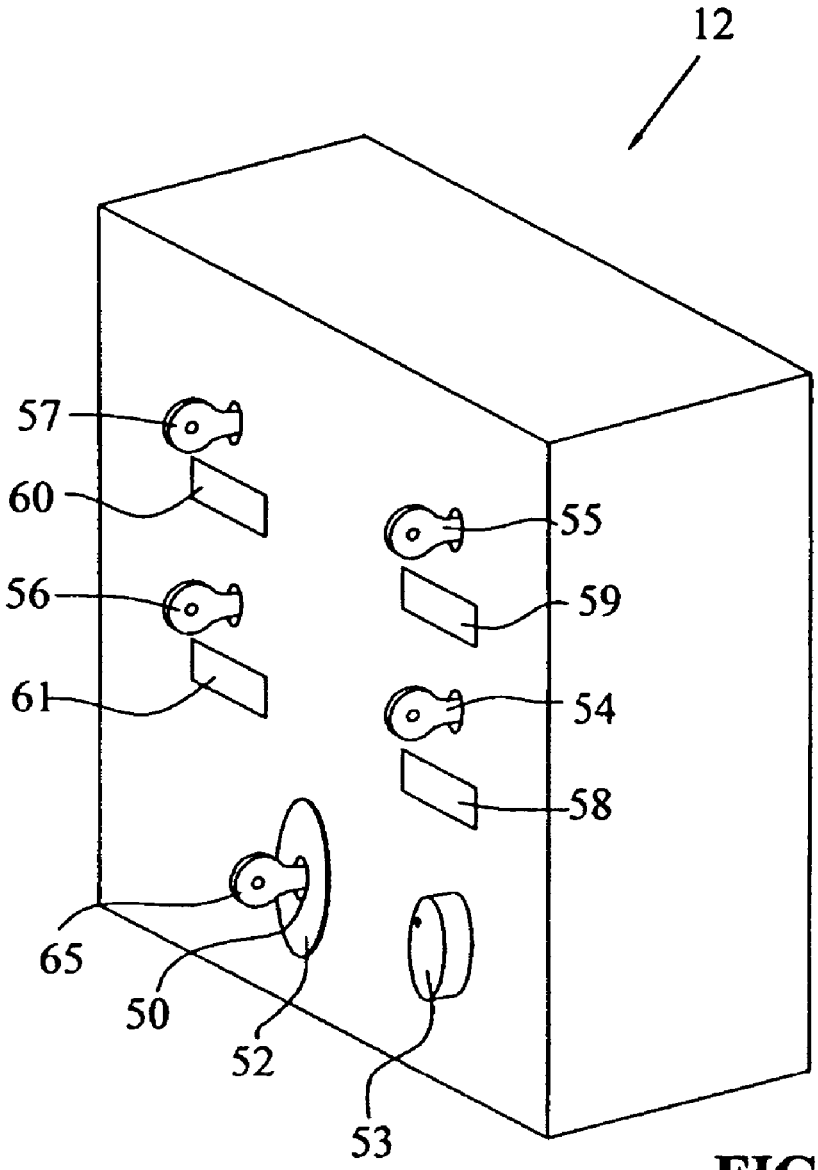
FIG. 5 is a perspective view of an alarm apparatus according to another embodiment of the present invention.

In another embodiment of alarm apparatus 12, depicted in FIG. 5, plurality of visual devices 54–57 and one audio device 53 are provided. Visual devices 54–57 and audio device 53 are electrically connected to key switch 50, within key switch box 51. Each of visual devices 54–57 may be positioned relative to corresponding component label 58–61, each indicates a specific component of pool cover assembly 11. For example, status label 58 may read "power source", and visual device 54 positioned relative to label 58 may be adapted to indicate the status of a power source connected to pool cover assembly 11. If the power source is malfunctioning, visual device 54 may show a red light or no light, thus the pool operator is alerted of the malfunction of the power source. In contrast, visual device 54 may show a green light when the power source is functioning normally.

Similarly, status label 59 may read "drive control", while visual device 55 positioned relative to label 59 is adapted to indicate the working status of the drive control. Status label 60 may read "drive mechanism", while visual device 57 positioned relative to label 60 is adapted to indicate the working status of the drive mechanism. Status label 61 may read "pool cover", while visual device 56 positioned relative to label 61 is adapted to indicate the status of the pool cover.

Audio device 53 may be adapted to produce a plurality of sounds, one or more of such sounds corresponding to any one or more of visual devices 54–57. A plurality of visual devices and/or audio devices may be provided with alarm apparatus 12. Additional visual devices or/and audio devices may be provided to indicate working status of other components of the pool cover or the swimming pool. For example, an audio device and a visual device may be adapted to indicate whether there is an object in the swimming pool such as an animal or a person. If the pool is being used, a red light may be showing at a specific position on the key switch box, to indicate to a pool operator that it is not safe to close the pool with the pool cover. On the other hand, if there is no one in the pool, the light may turn green, indicating that it is safe to extend the pool cover over the pool for closing.

As shown in FIG. 5, key switch box 51 has key slot 52 for receiving control key 65. Control key 65 may be turned to "open" position or "close" position. When control key 65 is in "open" position, the pool cover retracts, and when control key 65 is in "close" position, the pool cover extends over the pool. Control key 65 may be controlled by a time delay device (not shown). In one specific embodiment, a separate control switch may be provided for activating or deactivating the alarm apparatus. In addition, the alarm apparatus may include a plurality of individual switches (not shown) for turning on/off individual audio or visual devices.

Referring again to FIGS. 1 and 2, alarm apparatus 12 may be adapted to automatically turn off the operation of pool cover assembly 11 when sensor 13 detects a malfunction status of pool cover assembly 11, that warrants a shut down. For instance, sensor 13 may detect a stress in drive mechanism 22 when drive mechanism 22 is retracting pool cover 21, which has collected an overload of water or debris. If drive mechanism 22 continues operating, drive mechanism 22 may be damaged by the debris. Sensor 13 may send a signal indicating such stress to alarm apparatus 12. Apparatus 12, specifically software 36 (see FIG. 3) may be adapted to enable a termination of the operation of drive control 25, and thus stop drive mechanism 22 from continuing to retract pool cover 21. At the same time, an audio device may also produce a sound alarm signal to alert the pool operator, who may remove the water or debris, and restart the operation of pool cover assembly 11. It is possible that apparatus 12 may have a time delay device that enables system 10 to be turned on automatically after a predetermined time delay. It is also possible that sensors (not shown) could be associated with other elements of the pool cover system such as the coping etc.

Figure 6:
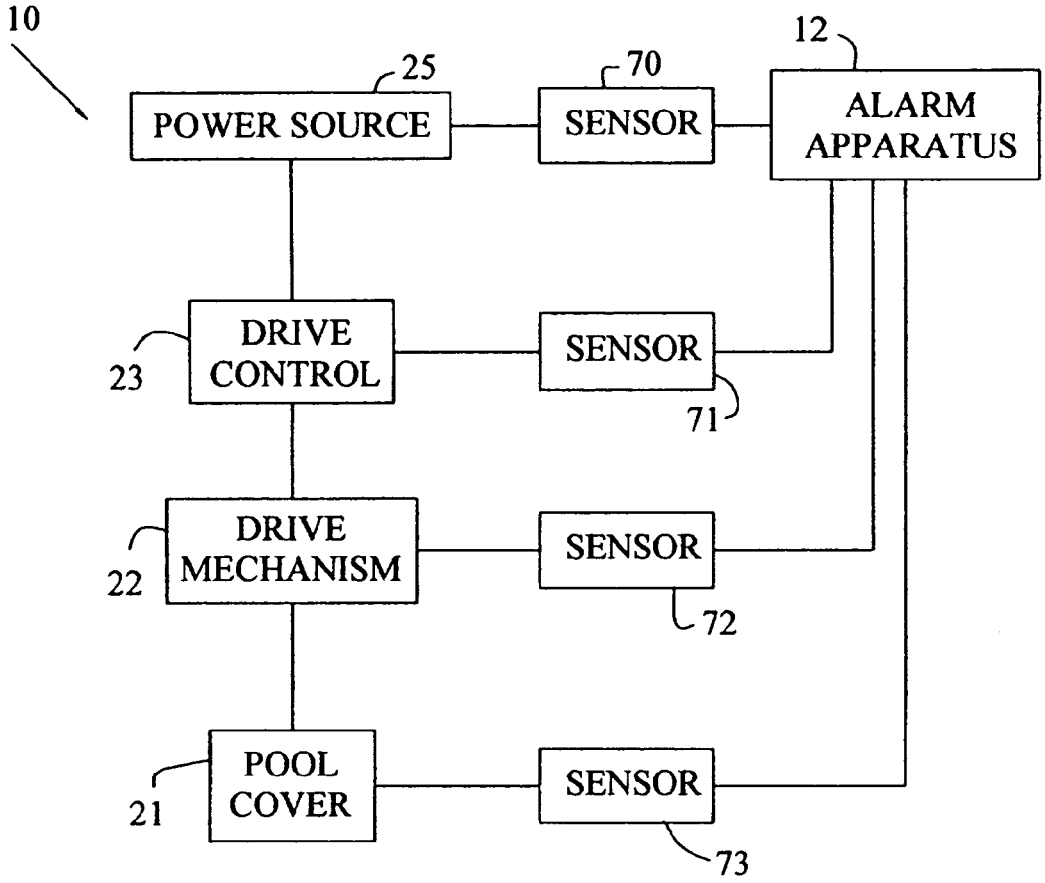
FIG. 6 is a schematic block diagram showing the system according to a third embodiment of the present invention.

Referring now to the diagram in FIG. 6, system 10 may include a plurality of sensors 70–73, each being operably connected to a different component of pool cover assembly 11. For example sensor 70 may be connected to power source 25 for monitoring the status of power source 25, or for detecting the presence or absence of power available for running drive control 23. Sensor 70 may be electrically connected to power source 25, which may be an electricity generator or a transformer or an electrical socket connected to an external power source. If there is electricity, sensor 70 may send a signal indicating "normal" to alarm apparatus 12, which subsequently produces a green light, indicating to the pool operator that the electricity is running normally. If there is no electricity, sensor 70 may send a signal representing "no power" to alarm apparatus 12, which may produce a red light.

It is possible that power source 25 may supply power to both alarm apparatus 12, and drive control 23. If power source 25 is malfunctioned, alarm apparatus 12 receives no power, no light is produced, indicating "no power" status of system 10.

In addition to sensor 70, system 10 may further include sensor 71 operably connected to drive control 23 for detecting the working status of drive control 23, sensor 72 for detecting status of drive mechanism 22, and sensor 73 for detecting the working status of cover 21. Other sensors may be included to detect working statuses of other components of the pool cover system including the presence of an object in the swimming pool, as discussed above.

Referring back to FIG. 3, each sensor 13 may send signal 14 to alarm apparatus 12 by one of several communications. For example, signal 14 may be in a form of electrical pulses or a radio frequency (RF). Sensor 13 may include transmitter 16 for transmitting RF to receiver 34 adapted to receive RF. Processor 35 may be adapted to process and recognize RF. Alternatively, infrared signals, ultrasound signals, microwave signals, or other communications channels may be similarly employed. Software 36 is adapted to enable alarm-producing device 30 to produce a humanly perceptible indication according to the recognized signal.

Figure 7:
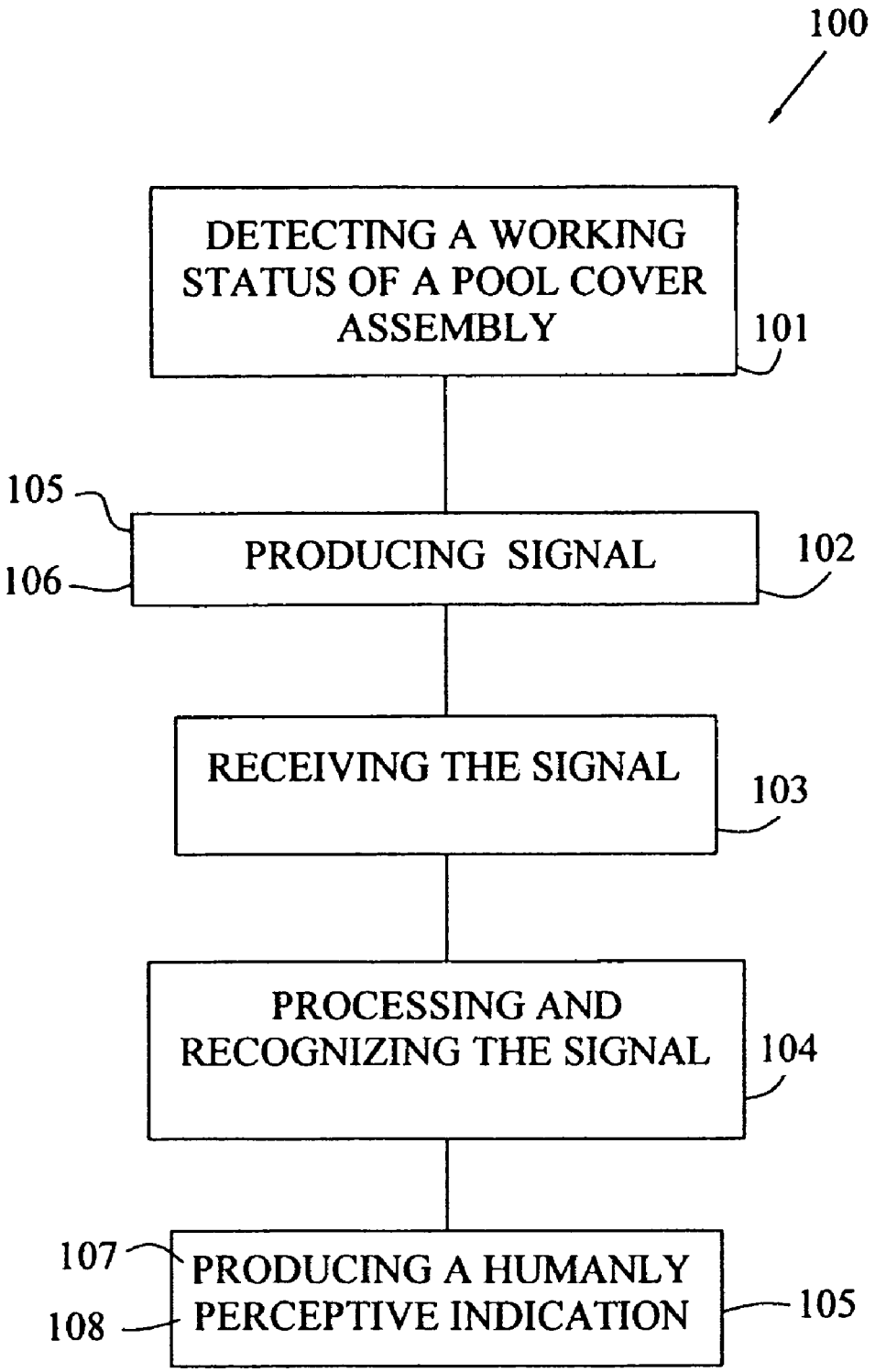
FIG. 7 is a flow chart diagram showing the method of the present invention.

The present invention further provides a method for monitoring statuses of pool cover assembly. According to FIG. 7, method 100 includes the steps of detecting a working status of a pool cover assembly 101, and producing a humanly perceptible indication 105 corresponding to the detected status of the pool cover assembly. The method 100 may further include the steps of producing a signal 102 representing the status of the pool cover assembly, receiving the signal 103, and processing and recognizing the signal 104 before the step of producing a humanly perceptible indication 105.

The step of producing signal 102 may include producing an electrical pulse signal, an RF signal, an infrared signal, a non-audible sound signal, etc. The step of producing a humanly perceptible indication 105 may include producing an audio alarm signal 107 and/or visual alarm signal 108.

Figure 8:
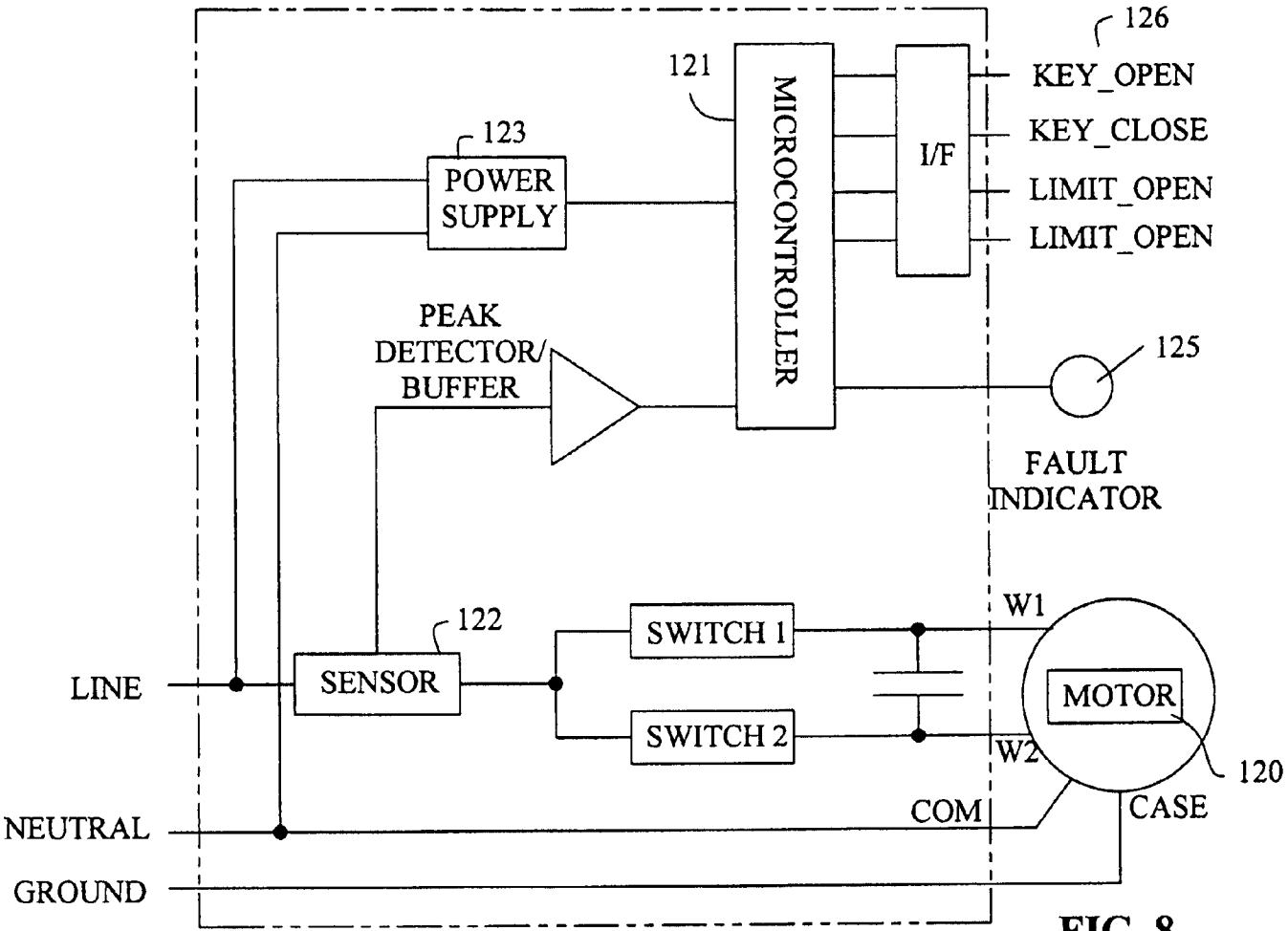
FIG. 8 is a block diagram showing components of the alarm system according to a fourth embodiment of the present invention.

In a specific embodiment of the present invention shown in FIG. 8, motor or drive mechanism 120 may be connected to microcontroller or microprocessor 121 and sensor 122. Power supply 123 supplies electrical power to motor 120, sensor 122 and microcontroller 121. When a fault condition occurs, sensor 122 sends a signal to microcontroller 121, which activates fault indicator or alarm-producing device 125. An operator may be able to turn key switch 126 on/off in response to the fault condition.

The following examples demonstrate types of working status that the alarm apparatus of the present invention may be used to diagnose. While the alarm status is described below in terms of flashing light emitting diode (LED) lights, the invention may be implemented with different visual signals, audio signals, or accessible electronic messages and fault indicators.

Limit Sensor Diagnostics: Controller will indicate a permanent fault condition if both limit sensors are activated at the same time, either on system power up or during normal run time. The fault condition is displayed to the operator by a flashing red LED at the keyswitch and motion in either direction is disabled. Fault cannot be reset to normal RUN status until condition is removed and power is toggled to the controller.

Keyswitch Diagnostics: Controller will indicate a permanent fault condition if both OPEN and CLOSE positions are activated at the same time, either on power up or during normal run time. The fault condition is displayed to the operator by a flashing red LED at the keyswitch and motion in either direction is disabled. Fault cannot be reset to normal RUN status until condition is removed and power is toggled to the controller.

Runaway Diagnostics: Controller will indicate a permanent fault condition if drive is operated (keyswitch inputs are activated) in either direction for a period exceeding 90 seconds. The fault condition is displayed to the operator by a flashing red LED at the keyswitch and motion in either direction is disabled. Controller will also indicate a permanent fault condition if no keyswitch input is activated but it detects motion (current to motor) from the system. Fault cannot be reset to normal RUN status until condition is removed and power is toggled to the controller.

Overload Diagnostics: Controller will indicate a temporary fault condition if a drive overload condition is sensed. This condition is sensed by an increase in motor current over a period of time (load slope=delta I/delta T). The controller does not respond to small load changes but does stop motion due to an increased load, which might cause damage to the cover or mechanical linkage. This method of load detection is different from other systems because there is no absolute overload threshold setting required by the installation technician and does not require adjustment over time due to changes in mechanical wear. The fault condition is displayed to the operator by a flashing red LED at the keyswitch and motion in either direction is disabled. The fault is reset after 10 seconds to a normal RUN condition provided there is no keyswitch input (keyswitch has been released) and the motor current level is below a programmed minimum value. Operator can then attempt to run cover in either direction and fault will occur again if the overload condition has not been eliminated.

It is contemplated that microcontroller 121 may be electronically and remotely connected to alarm-producing device 125. For example, microcontroller 121 may be a computer system communicating via a telephone or cable line with alarm producing device 125. A user may be able to operate microcontroller from a remote station to operate key switch 126 to turn motor 120 on and off in response to the fault indication. Further user interfaces or control features may be provided in software at the remote station.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A system for monitoring a working status of a pool cover assembly for a swimming pool comprising:

a pool cover assembly having:

a pool cover;

a drive mechanism connected to said pool cover for retracting and extending said pool cover; and an alarm apparatus operably connected to said pool cover assembly, said alarm apparatus including an output device capable of producing a humanly perceptible indication corresponding to a working status of said pool cover assembly.

2. The system of claim 1 further comprising a sensor operably connected to said alarm apparatus and said pool cover assembly, said sensor capable of detecting the working status of said pool cover assembly, producing a signal corresponding to the working status, and sending said signal to said alarm apparatus.

3. The system of claim 2 further comprising a plurality of sensors operably connected to said alarm apparatus and said pool cover assembly.

4. The system of claim 3 wherein said output device includes a light emitting diode.

5. The system of claim 4 further comprising a user disable device coupled to said drive mechanism so that operations of said alarm apparatus and said pool cover assembly may be disabled by a user.

6. The system of claim 5 further comprising a user reset device so that said operations of said alarm apparatus and said pool cover assembly may be reset.

7. The system of claim 2 wherein said pool cover assembly further comprises:

a drive control operably connected to said drive mechanism for driving said drive mechanism to extend and retract said pool cover over the swimming pool; and a power source connected to said drive control for supplying power to operate said drive control.

8. The system of claim 7 wherein said output device includes at least one of: an audio device, a visual device, and a combination thereof, wherein said audio device is capable of producing predetermined sounds, and wherein visual device is capable of producing predetermined light.

9. The system of claim 8 wherein said alarm apparatus further comprises a key switch operably connected to said pool cover assembly for turning on and shutting off said pool cover assembly.

10. The system of claim 9 wherein said key switch is operably connected to said alarm-producing device for turning on and shutting off said alarm-producing device.

11. The system of claim 9 wherein said alarm apparatus further comprises:

a receiver for receiving the signal from said sensor;

a processor operably coupled with said receiver for processing the received signal; and software operably coupled with said processor capable of selectively enabling said alarm-producing device to produce the humanly perceptible indication.

12. The system of claim 11 wherein said processor determines changes over time in electric current running through said alarm apparatus.

13. The system of claim 11 wherein said software enables said alarm-producing device to produce a flashing red LED light.

14. The system of claim 11 wherein said sensor is electronically coupled to said alarm apparatus, said sensor capable of producing an electronic signal, and said receiver of said alarm apparatus is adapted to receive the electronic signal.

15. The system of claim 11 wherein said alarm apparatus includes a sensor and a transmitter for transmitting the signal over a radio frequency, and said receiver of said alarm apparatus is adapted to receive the radio frequency.

16. The system of claim 7 wherein said alarm apparatus includes a power source sensor operably coupled to said power source for detecting a working status of said power source.

17. The system of claim 7 wherein said alarm apparatus includes a drive control sensor operably coupled to said drive control for detecting a working status of said drive control.

18. The system of claim 7 wherein said alarm apparatus includes a drive mechanism sensor operably connected to said drive mechanism for detecting a working status of said drive mechanism.

19. The system of claim 7 wherein said alarm apparatus includes a sensor capable of detecting a working status of more than one of said power source, said drive control, said drive mechanism, and said alarm apparatus.

20. An alarm apparatus adapted to be used with a pool cover assembly having components including a pool cover, a drive mechanism connected to the pool cover, a drive control operably connected to the drive mechanism for driving the drive mechanism to extend and retract the pool cover over a swimming pool, and a power source connected to said drive control for supplying power to operate the drive control, comprising:

at least one alarm-producing device capable of producing a plurality of humanly perceptible indications;

a sensor coupled to said at least one alarm-producing device and adapted to be operably coupled with the pool cover assembly, said sensor capable of detecting working statuses of the pool cover assembly and producing a signal associated with the status; said at least one alarm-producing device capable of producing one of said humanly perceptible indications in response to the signals.

21. The alarm apparatus of claim 20 wherein said at least one alarm-producing device includes at least one of: an audio device, a visual device, and a combination thereof.

22. The alarm apparatus of claim 20 further comprising a plurality of sensors coupled to said at least one alarm-producing device adapted to be operably coupled with the pool cover assembly and producing signals associated with the statuses.

23. The alarm apparatus of claim 22 further comprising a key switch operably connected to said pool cover assembly for operating said pool cover assembly.

24. The alarm apparatus of claim 23 wherein said key switch is operably connect to said at least one alarm-producing device for operating said at least one alarm-producing device.

25. The alarm apparatus of claim 24 further comprising a receiver operably connected to said plurality of sensors for receiving signals;

a processor operably coupled with said receiver for processing and recognizing the received signals; and software operably coupled with said processor enabling said at least one alarm-producing device to produce a humanly perceptible indication in response to the signals.

26. The system of claim 25 wherein each of said plurality of sensors is electronically connected to said alarm apparatus, each said sensor producing an electronic signal, said receiver adapted to receive the electronic signal, and said processor adapted to process and recognize said electronic signal.

27. The system of claim 25 wherein at least one of said plurality of sensors includes a transmitter for transmitting a radio frequency (RF) signal, said receiver adapted to receive the RF signal, and said processor adapted to process and recognize the RF signal.

28. The system of claim 22 wherein said plurality of sensors includes a power source sensor adapted to be operably connected to the power source for detecting a working status of the power source.

29. The system of claim 22 wherein said plurality of sensors includes a drive control sensor adapted to be operably connected to said drive control for detecting a working status of the drive control.

30. The system of claim 22 wherein said plurality of sensors includes a drive mechanism sensor adapted to be operably connected to the drive mechanism for detecting a working status of the drive mechanism.

31. The system of claim 22 wherein said plurality of sensors includes an alarm apparatus sensor capable of detecting a working status of more than one of said power source, said drive control, said drive mechanism, and said alarm apparatus.

32. A method for monitoring a working status of a pool cover assembly having components including a pool cover, a drive mechanism connected to the pool cover, a drive control operably connected to the drive mechanism for driving the drive mechanism to extend and retract the pool cover over a swimming pool, and a power source connected to said drive control for supplying power to operate the drive control, comprising the steps of:

(a) providing an alarm apparatus, (b) detecting a working status of a pool cover assembly, and (c) producing a humanly perceptible indication corresponding to the detected status of the pool cover assembly.

33. The method of claim 32 further comprising the steps of:

(d) producing a signal representing the status of the pool cover assembly;

(e) receiving the signal; and (f) processing and recognizing the signal.

34. The method of claim 33 wherein said step of (d) producing a signal includes at least one of: producing an electrical pulse signal, a radio frequency (RF) signal, infrared signal, ultrasound signal, and microwave signal.

35. The method of claim 32 wherein said step of (c) producing a humanly perceptible indication includes at least one of: producing an audio alarm signal, and producing a visual alarm signal.

36. The method of claim 32 wherein said step of (b) detecting a working status of pool cover assembly includes detecting a fault condition.

37. The method of claim 36 further includes the steps of: (g) correcting the fault condition.

* * * * *